US007566037B2

(12) United States Patent
Vogler

(10) Patent No.: US 7,566,037 B2
(45) Date of Patent: Jul. 28, 2009

(54) PUSHER ACCESSORY FOR PRODUCT HANGING HOOKS

(76) Inventor: Michael N. Vogler, 50 Planchet Road, Concord, Ontario (CA) L4K 2C7

( * ) Notice: Subject to any disclaimer, the term of this patent is extended or adjusted under 35 U.S.C. 154(b) by 0 days.

(21) Appl. No.: 11/710,439

(22) Filed: Feb. 26, 2007

(65) Prior Publication Data

US 2008/0203253 A1 Aug. 28, 2008

(51) Int. Cl.
*E04G 5/06* (2006.01)
*A47F 5/08* (2006.01)

(52) U.S. Cl. ..... 248/220.31; 248/220.41; 248/221.11; 211/54.1; 211/59.1

(58) Field of Classification Search ..... 248/220.31, 248/220.41, 220.42, 221.11; 24/463, 561; 211/54.1, 57.1, 59.1
See application file for complete search history.

(56) References Cited

U.S. PATENT DOCUMENTS 4,475,658 A * 10/1984 Roberts ..... 211/54.1
5,222,608 A * 6/1993 Eklof et al. ..... 211/54.1
5,906,283 A * 5/1999 Kump et al. ..... 211/54.1
6,158,598 A * 12/2000 Josefsson ..... 211/54.1
6,957,555 B1 * 10/2005 Nagel et al. ..... 248/220.31
7,278,617 B2 * 10/2007 Valiulis et al. ..... 248/220.31

OTHER PUBLICATIONS

Two Pages From On-line Catalogue of Southern Imperial, Inc. (Address Unknown) Extracted From the "Web-Page" of That Company: General Web Address: "SOUTHERNIMPERIAL.COM" Specific Web Address for These Pages: "SOUTHERNIMPERIAL.COM/SELF-FACING HOOKS" p. 1: General Page for Category of "Self-Facing Hooks" p. 2: Illustrative Page (with enlarged view of product) for Sample Item "RSF-33-12H".

* cited by examiner

*Primary Examiner*—Amy J Sterling
*Assistant Examiner*—Tan Le
(74) *Attorney, Agent, or Firm*—William J. Daniel

(57) ABSTRACT

A pusher accessory for assembly conventional elongated product display hooks configured at one end for anchorage on a supporting panel or board and supporting in suspended fashion along their length a multiplicity of product items for removal from the opposite free end of said hook. The pusher accessory has a stationary component for attachment in fixed position adjacent the free hook end; a movable component mountable on the hook for free sliding movement there along; and an extensible tension spring affixed at one end to the stationary component and carried at the other end by the movable component. When extended by separation of the movable component and intervening product packages suspended from the hook, the spring applies spring tension force to the movable component and intervening packages and advances the latter as product packages are removed. Preferably, the spring is a flat coil spring carried at the coil end by the movable component. Preferably, the fixed component is clampingly engaged in its fixed position adjacent the free end of the hook.

18 Claims, 4 Drawing Sheets

PUSHER ACCESSORY FOR PRODUCT HANGING HOOKS

INTRODUCTION

This invention relates to the field of merchandizing displays of product packages suspended from horizontally extending product support hooks anchored at their base ends in cooperating apertures provided for that purpose in a supporting panel board, wire grid or other backing structure and is concerned, more particularly, with an accessory for these support hooks which serves to maintain the product packages thus suspended and displayed in positions of ready accessibility to the potential purchaser as product packages are removed one-by-one by customers.

BACKGROUND OF THE INVENTION

In many areas of commerce, an almost infinite variety of small items for sale, typically but not necessarily exclusively, enclosed in a plastic package or wrapping, usually with a cardboard or other insert carrying descriptive information about the product, are suspended from elongated generally rigid wire or plastic hooks or prongs supported at one end of the hooks on an apertured supporting structure with the other end passing through slots in the packages so that the product packages are suspended or hanging from the hooks for observation and choice by a potential purchaser for the product in question. The hooks are made long enough to support a multiplicity of the items at the same time and at their free ends are ordinarily (but not necessarily) tilted or inclined upwardly at a slight angle to keep items from falling off inadvertently. With the approximately horizontal orientation of the hooks, as one item is removed, the remainder do not advance (or slide down) to the free inclined hook ends but stay in their initial positions spaced therefrom. Consequently, after the leading item is removed, access to the next item on a given hook can be awkward, especially if a considerable number of the hooks are arranged on the supporting board in fairly close proximity, as is desirable from the merchant's standpoint for maximum utilization of the display area. Thus, there is need for display hooks equipped with a "pusher" operating from the rear as the leading item of a hook is removed by a customer, to advance or displace forwardly the remaining items on that hook so that the next item assumes the forward accessible position thereon, this function being repeated for the next items in series until a sufficient number of items have been removed for sale, and a fresh group of items are loaded on the hook forward of the pusher to begin the procedure all over again.

There are now available in the marketplace display hooks that have been re-designed in entirety to incorporate a pusher feature. While this is one solution to the problem, it confronts the merchant with a different, and perhaps more serious from the merchant's viewpoint, problem in that this solution renders obsolete and superfluous the merchant's existing inventory of conventional display hooks and requires the purchase of new, and presumably more expensive, hooks of the new configuration.

There is, hence, a need for an accessory suitable for association with, or assembly on, existing conventional display hooks that functions, as the front item is removed from a hook, to "automatically" shift forwardly any items remaining on the hook until the new leading item encounters resistance at the free hook end but without, of course, pushing items entirely off of the hook.

OBJECTS OF THE INVENTION

An object of the present invention is to meet the just-stated need by providing a pusher accessory for at least some of the more common existing conventional product display hooks that can be applied to the latter without modification of their present configuration so that merchants already utilizing for their business such conventional display hooks can benefit from the pusher feature without the necessity for replacing an inventory of conventional hooks with new specially designed hooks.

Another object is a pusher accessory comprised of a stationary component adapted to be attached in fixed position adjacent the free end of a conventional product display hook, a movable component mountable on the hook at a point spaced from the stationary component for free sliding movement back and forth along the hook length and including a product-contacting face, and spring means anchored at one end to the stationary component and carried at the other end by the movable component that is extended when the movable component is separated from the stationary component by intervening product packages suspended from the hook intermediate such components to apply spring tension force to the movable component and advance the same and the intervening packages along the hook length until the leading product package encounters resistance adjacent the free hook end.

A further object is a pusher accessory as described in the preceding object wherein the spring means is a flat coil spring having a free end shaped for attachment to the stationary component with the coil thereof supported for free flexing movement by the movable component and guided along a predetermined path parallel to the hook length by guide surfaces on the movable component.

An additional object of the invention is a pusher accessory for display hooks as set forth having at least one elongated generally rigid wire length and the movable component thereof has a body portion with an aperture encircling such wire length for free axial movement of the movable component along the wire length and which includes a downwardly directed panel providing the product-contacting surface on a side facing the stationary component and on the opposite side of such panel spaced apart brackets or buttresses laterally confining the coil of the flat coil spring there between for its free flexing movement.

Yet another object is a pusher accessory adapted for association with conventional display hooks of the types having two generally parallel lengths of wire that are spaced apart relative to their use position either horizontally or vertically and the movable component of the accessory is interchangeable between the two types.

Yet a further object is a pusher accessory having a stationary component adapted for assembly with a product display hook having two generally horizontally parallel lengths of wire joined at the forward ends thereof spaced from the supporting panel by a U-shaped bight and the stationary component of the accessory is adapted for clamping engagement with the wire lengths adjacent their free end and for that purpose preferably includes a body portion "pinched" between the respective wire lengths directly upstream of the bight and on the body portion an extension or "neck" directed forwardly toward the bight, the extension terminating in an open "beak" clampingly gripping in the opening thereof the crossing part of the bight; and where the bight end of the wire lengths is inclined forwardly and upwardly, the neck is similarly inclined to bring its beak-shaped end into generally horizontal alignment with the crossing part for effective gripping thereof.

Another object is a pusher accessory having a stationary component adapted for assembly with the product display hook having two generally vertically parallel lengths of wire or legs connected together at their ends adjacent the supporting board or panel and configured at such ends for anchorage on the board or panel with the opposite ends thereof free, the lower of the two wire lengths functioning to support product display packages suspended therefrom, and the stationary component of the accessory comprises a body portion laterally slotted along one side for clamping engagement with the upper of the wire lengths adjacent the free end thereof, the body portion having on its underside a connecting means for attachment to the free end of spring means carried at its other end by a movable accessory component.

A further object is a pusher accessory as set forth if the preceding object wherein the body portion is laterally slotted on both of its opposite sides, the slots being of different diameters for clamping engagement with product display hooks of correspondingly different diameters.

Other objects and advantages will become apparent as the following detailed description of the invention proceeds.

DETAILED DESCRIPTION OF ILLUSTRATIVE EMBODIMENTS OF THE INVENTION

Figure 1:
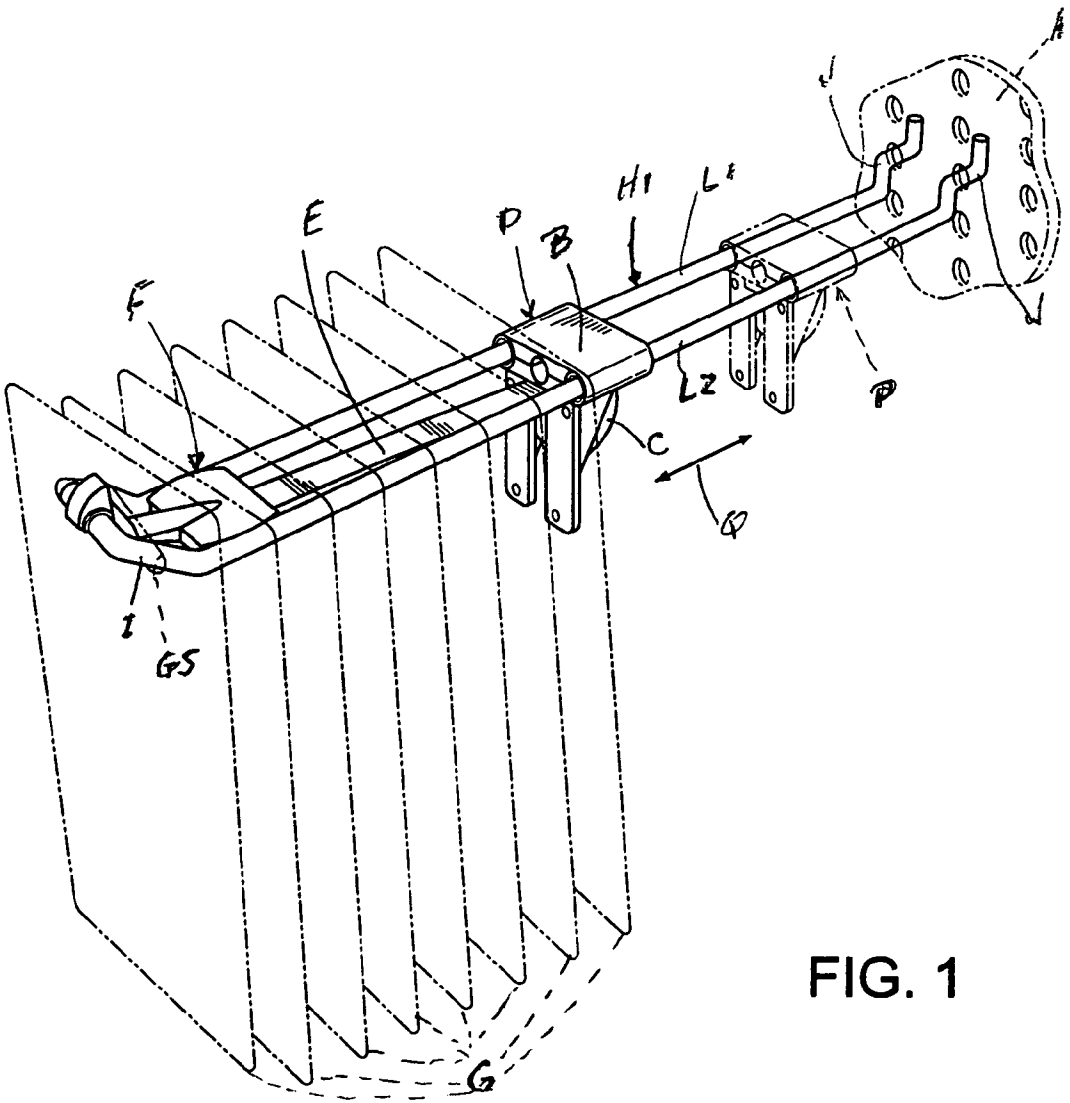
FIG. 1 is a perspective view taken from the free or unsupported end of an assembly of one embodiment of the pusher accessory of the invention associated with a product display hook having two horizontally parallel wire lengths configured, e.g. bent, at one end for supporting engagement with apertures of an apertured supporting board shown in dotted lines, and having suspended therefrom along the wire lengths away from the bent ends, a plurality of product packages for display being shown in highly idealized fashion in phantom, the accessory having a stationary component constructed for association with such a display hook affixed to the same adjacent its free end, a movable pusher component mounted on the hook for sliding movement along its length shown first in dotted lines at one position somewhat proximate to the supporting board and in solid lines further along the hook length to suggest visually the movement of the movable component

The invention is expressly characterized as an "accessory" for existing conventional product display hooks, by which is intended to bring out that the invention is an "addition" or "compliment" to existing conventional display hooks, requiring no modification of the structure of those hooks. The conventional display hooks for which the illustrative embodiments of the invention are provided are of two configurations, both of which utilize two "legs" or lengths of wire extending parallel to one another and in their normal use position in a horizontal direction. In one case, the two lengths of wire are separated horizontally and both pass together through a horizontal slot formed in product display packages to enable suspension of such packages from the hook wires. Usually, the legs of the hooks in this case terminate in short upwardly inclined portions the purpose of which is to prevent, or at least resist, unintended displacement of the packages off of the hook and, preferably, the ends of such inclined portions are connected together to form a "U", referred to herein as a "bight". The precise upward angle of the bight portion is by no means critical and can vary according to the desires of a particular customer for the hooks. An angle of about 15-20 degrees of usually satisfactory.

In the other case, the wires are separated vertically without connection at their free ends. Only the lower of the two wires in this case functions to support product packages by passage through the package slots for suspension of the packages therefrom and a terminal part of the lower wire may be bent either to one side or upwardly, again to resist unintentional falling off of any package. The upper wire in this case serves mainly a stabilizing function (but is ideally suited to give support to the components of the invention in this embodiment).

The selection of the term "wire" to describe the legs of the conventional display hooks is purely for convenience and is intended to cover without limitation whatever types of rodlike structural materials that are known and accepted for use for this purpose. The hooks are, indeed, often made of substantially rigid wire-like metallic materials, sometimes covered with a plastic coating for better durability, but certainly other materials such as plastics could be substituted. By "substantially rigid" does not mean that the legs cannot be bent under force but that the legs are sufficiently strong that they do not bend or twist under normal loads. These hooks are supported at one (base) end from a perforated board, panel, grid or the like and typically in order to achieve such support such ends are bent into upstanding fingers with adjacent shoulders to maintain the hooks in their horizontal use position. Construction of these display hooks including the configurations of their base supporting ends is well known in the art (see, for example, in this connection the background discussion in U.S. Pat. No. 6,189,247, which, if need be, is incorporated by reference) and forms no part of the present inventive contribution, other than as a context for that contribution.

First Preferred Embodiment

Turning now to a description of the preferred embodiments illustrating the invention, the hook generally designated H1 has two horizontally parallel legs L 1 and L2 with, for example, a diameter of 3/16's or ¼ in. and spaced apart in this case approximately one (1) in. which are adapted at one (the right in the drawings) of their ends for anchorage in apertures provided for that purpose in a supporting panel A shown in dotted lines, the two leg ends being bent to form fingers J for effective engagement with the panel apertures. Other forms of support, such as a wire grid, are known for this purpose and could be employed instead. At the opposite ends of the legs L from their bent supporting ends J, is mounted a fixed or stationary component, generally designated F, according to this embodiment (the details of which appear more clearly in FIG. 2), and intermediate fixed component F and the supported leg ends a movable pusher component generally designated P (shown more clearly in FIG. 3) is carried on legs L for free sliding movement there along. Pusher component P is shown in dotted lines in a position along legs L near panel A and in solid lines in a position shifted to the left somewhat toward fixed component F, a double-headed arrow Q being given to give a visual indication of the movability of pusher P. Stretching between the movable and fixed components is an extended length E of a flat coil spring C carried beneath movable pusher P, only a small part of the coil being visible in FIG. 1. The free end of extended coil length E is attached to fixed component F on its underside (not visible in this figure). Shown suspended (or hanging) from legs L between pusher P (solid line position) and bight I at the free (left) end of hook H1 are a plurality of product display packages G, each having at their top, center a small horizontal slot GS for hanging from the legs, one such slot being visible in the leading or leftmost of the packages G.

The extension (unwinding) of length E from the flat coil spring C sets up a tension force by virtue of the coil return characteristic and with the free end of length E anchored on fixed component F and the coil carried bodily on pusher P, that force is imparted to pusher P, urging it toward the fixed component F and pushing the product packages G before it until the leading package encounters resistance adjacent the bight I. That resistance is readily overcome by the deliberate action of a customer to remove a package but is sufficient to hold the packages in place on the holder until that deliberate action occurs.

Figure 2:
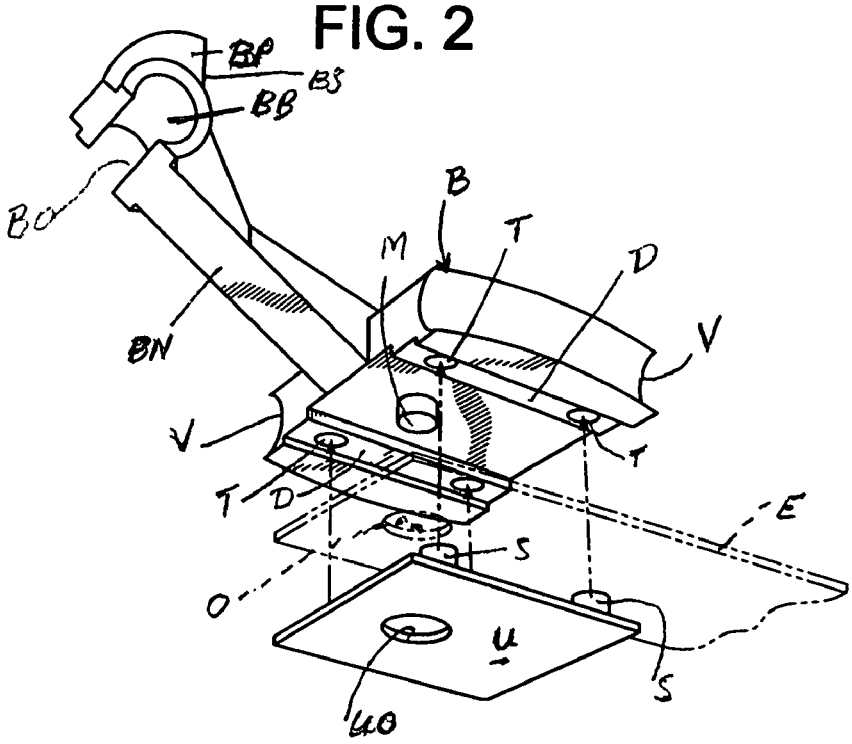
FIG. 2 is an enlarged (compared to FIG. 1) exploded perspective view taken from the left of the stationary component of FIG. 1 showing in detail the forward extension and "claw" of that component as well as one example of a manner of attachment of the forward free end of the tensioning flat coil spring to the stationary component.

As visualized in FIG. 2, the fixed component F has a body part B of a width fitting between the legs L of the holder and a thickness approximating the diameter dimension of the legs L, in this case, e.g. 3/16's in. The side edges or lateral faces of body B are concavely shaped, as at V, giving a semi-cylindrical recess of about the same diameter, e.g. 3/16's in., as the leg diameter to receive the curvature of legs L which given the fixed separation of the legs L by the apertures of board A, "squeezes" body B between the corresponding segments of legs L with at least some degree of clamping force. On its downwardly directed face, body B is recessed as a R to a depth and width accommodating the free end of extended coiled spring length E, seen in dotted lines in FIG. 2. For anchoring the spring end to fixed component F, a hole O is formed in center of the spring end and a mating peg M projects from the recess surface. Accidental separation of the hole and peg is blocked by a cover place U having at its corners pins S press-fitted into sockets T in the lower face of body part B. Preferably, the lateral margins of recess R are stepped as at D to accommodate the side edges of cover plate U, thereby imparting a flat or smooth undersurface to body B and avoiding unevenness that might hang up on edges of the package slot during removal of a package. Peg M can project below the plane of the lower face of body part B into an opening MO in cover place M to positively prevent the spring end from being detached during operation. The smooth movement of the spring length E back-and-forth, the axis of peg M should lie in vertical plane centered between the two legs of the hook.

Obviously, the free end of spring extension E can be attached to the fixed part F is other ways than the hole and peg. For example but not shown, the sides of the spring might be notched for engagement with matching shoulders in the recess or the extreme end of the spring might be bent more or less perpendicular to the normal plane of the spring, e.g. to form a lip, and the bent end hooked on the front face of body B, to mention just two possibilities.

Given the presence of an upwardly inclined end on the hook H1 forming the bight I, it is preferred for more positive engagement of the fixed part F with the hook end, that an extension BN be formed on the face of its body B directed away from the supported end of the hook in the nature of a "neck" that likewise is inclined upwardly toward the bight, and that the neck end in a "beak" BB with an open mouth BO. The beak interior is generally C-shaped with a diameter such as to tightly grip or clamp around a hook wire at the bight, e.g. about the same as that of the hook leg or 3/16's in. and is adapted to be snapped around the bight wire via its mouth. For that purpose, the mouth edges are separated a distance slightly less than the leg diameter but not so great as to prevent entry of the leg into the beak interior and the beak walls can undergo some flexure. In this manner, a tight clamping grip is applied to the leg wire by the beak and to insure against unintentional disengagement of the beak from the wire, the mouth of the beak preferably faces at a downwardly and forwardly angle as shown.

To guard against unintentional displacement of the packages G off of the hook under the pushing force of the pusher in the event that the upward inclination of the wire end does not offer sufficient resistance against that action, an upwardly projecting apex or peak BP, somewhat resembling the "coxcomb" of birds, can be present of the top of the beak ending facing the packages with a more or less vertical shoulder BS capable of blocking passage of a package until the package is deliberately raised for removal by a customer.

Figure 3:
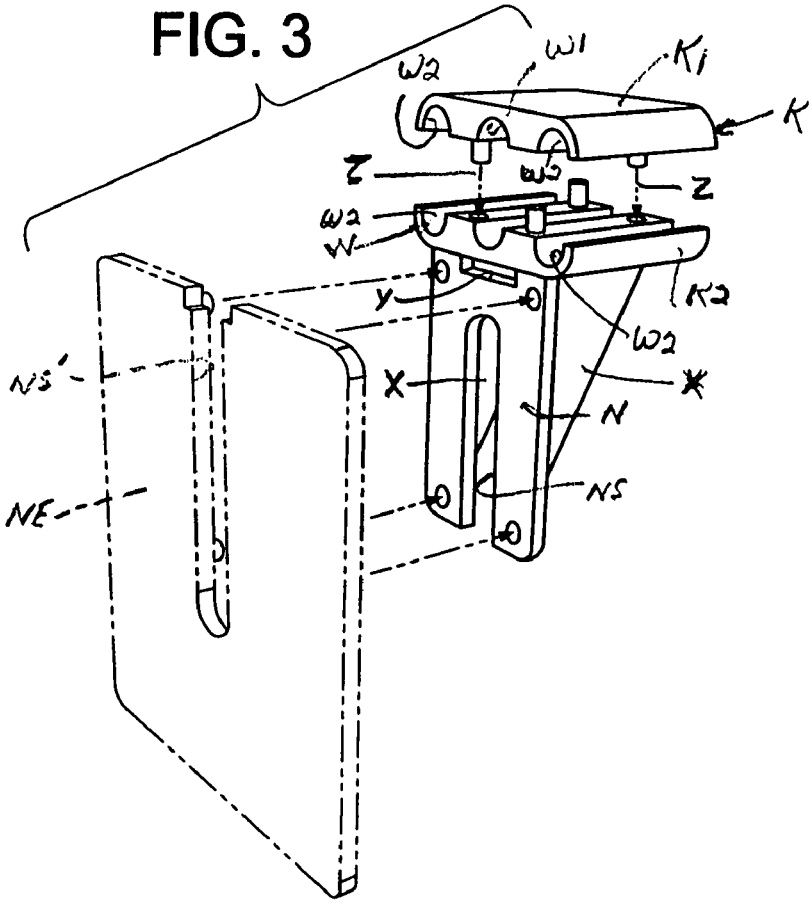
FIG. 3 is also an enlarged (compared to FIG. 1) exploded perspective view also taken from the left of the movable component of FIG. 1 showing the sockets (three) formed therein, of which the outside two are utilized in this embodiment, for loosely receiving the wires of the display hooks as well as the downwardly extending panel for maintaining secure pushing contact with the product packages (not seen in this view), the slot at the top of the latter panel for guiding the flat coil spring to an from its coil (not seen in this view) behind the panel, and finally an optional augmented or enlarged product-contacting panel which may be preferable for large size product packages.

The details of one preferred form of the pusher component or part P are found in FIG. 3. In this form, the pusher has a body K made up of two mating parts K1 and K2 somewhat similar to a "clam shell" which can be assembled together in "embracing" relation around the hook legs L by means of peg-and-socket connections, designated collectively with arrows suggesting their joinder as Z, in mutually facing surfaces thereof. The body K is penetrated by three bores W extending parallel to the lengthwise direction of the display hook, one of which W1 is centrally situated while the other two W2 are located laterally on each side, i.e. outside, of central bore W1 with a spacing there between corresponding approximately to the lateral separation of hook legs Le. g. about 1 in. apart. All three bores are given a diameter at least slightly larger than the diameter of the leg encircled thereby to enable the pusher to slide free to-and-fro along the hook legs. As an illustrative example, for legs 3/16's in. in diameter, the bore diameter might be ¼ in. The outside bores W2 are associated with the horizontally separated legs L of the first hook embodiment of the invention while the central bore W1 is provided for association with a leg of the second embodiment (having vertically spaced apart legs) to be described hereinafter. By virtue of the present in pusher P of the three bores, the pusher become useful interchangeably with both embodiments which is a advantage for the merchant. However, it will surely be obvious that separate pushers could be made for the two embodiments with the bores thereof limited to what is actually required for the particular embodiment.

Depending from the lower of the pusher body "clamshells" K2 along an edge thereof at one end of the bores therein (which will be deemed to be the "front" edge, i.e. the edge toward the fixed component or part F when assembled) is a flat plate N which extends generally vertically relative to the use position for maintaining contact with one side of product packages G hanging from the hook. If the particular packages being displayed are of a size deemed too large for reliable action by a given plate size, while that size could be increased in the original manufacture of the plate, a preferred option is to enlarge or increase the face size of the pusher plate N, by the addition of an optional supplemental plate NE shown in dotted lines and affixed to the plate by peg-and-connections, as indicated in the drawing.

Reference has been made to the utilization of a flat coil spring C for supplying pushing force to the pusher. The coil of the spring is preferably "housed" beneath the lower of the body parts W2 and behind the pusher plate N. For this purpose, a pair of laterally spaced apart brackets or buttresses X are formed integrally with part W2 and plate N to extend rearwardly of the plate. The configuration of brackets X can be varied, e.g. rounded, rectangular or even elongated like "tabs", but a triangular shape decreasing in length downwardly, as shown, has been found quite suitable. The lateral distance between the mutually directed faces of the brackets is such as to confine the spring coil there between while allowing free uncoiling and re-coiling (rotation) of the coil as the pusher functions, e.g. about 21/32's in. for a typical coil spring. Of course, the configuration of the brackets in question can be varied; for example, they could be formed with a lateral thickness, i.e. as a three-dimensional body for increased strength, provided that their mutually facing surfaces are generally flat or planar for free turning of the coil spring there between.

The extended end E of the coil spring must, of course, pass through the pusher plate N and an opening of sufficient magnitude is provided in the plate for this purpose. Preferably, this opening is a narrow elongated (to accommodate the spring width and thickness) slot Y (e.g. about 3/32's×1 in. for an average coil spring) in the top center of plate N immediately beneath the lower body part W2 with the slot axis generally perpendicular to the confining surfaces of the brackets, which slot guides the spring extended length along its proper path and maintains the same under control. Although additional support for retention of the coil spring, such as an "axle" or the like, not shown, might be employed if desired, this has not been found to be necessary in as much as spring guide slot Y holds the coil vertically while the brackets hold it in place laterally without hindering the coiling action thereof.

Second Preferred Embodiment

Figure 4:
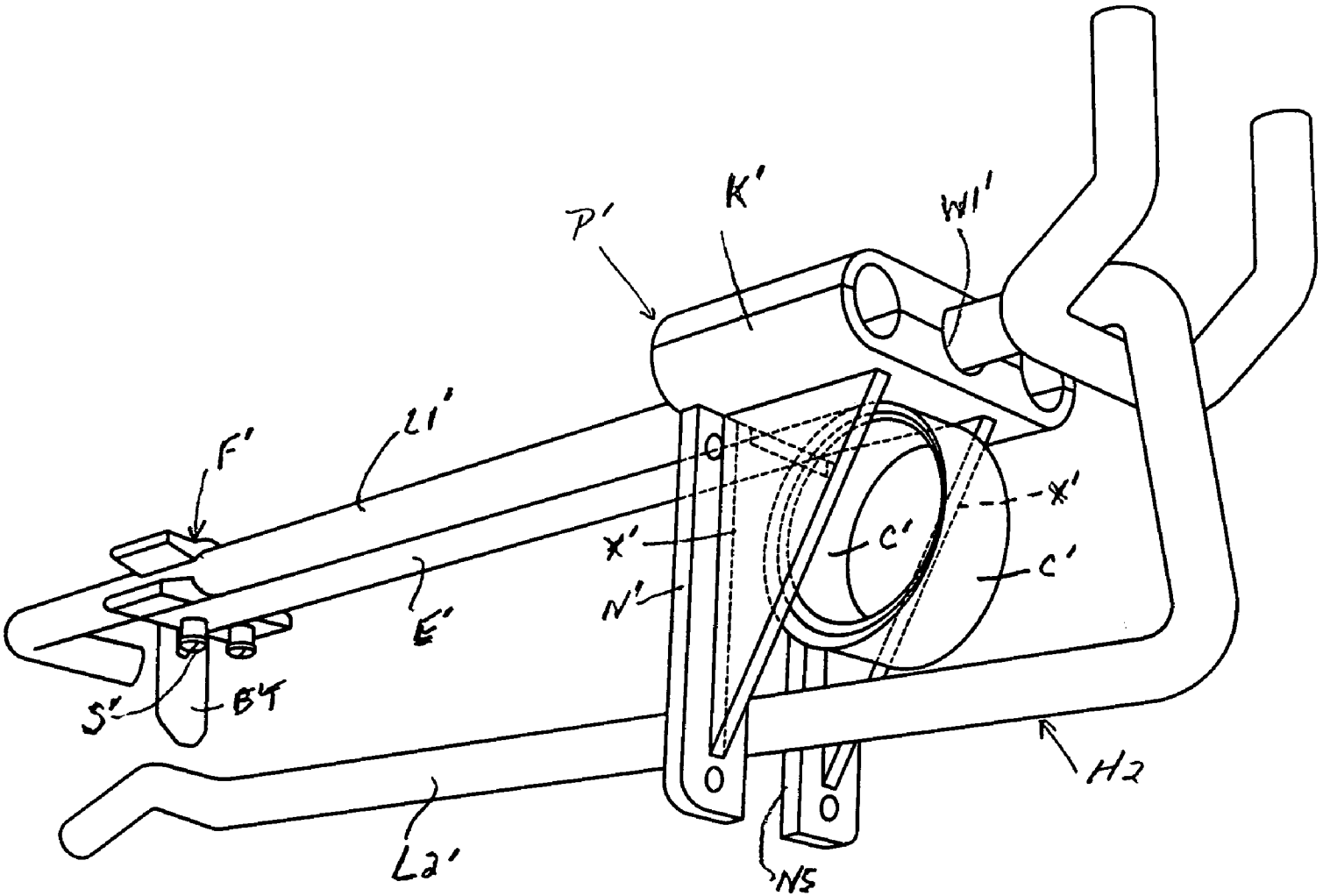
FIG. 4 is enlarged (compared to FIG. 1) perspective view take from the right (or normally supported end, the support being omitted) of a second embodiment of a pusher accessory of the invention suitable for assembly with a product display hook composed of two wire lengths extending in vertically separated generally parallel relation, showing the penetration of the movable component (which is similar to that of the first embodiment, the movable component being structured for interchangeability between the two types of display hooks) via a central socket in the body portion thereof, the lateral confinement of flat coil spring between spaced brackets or buttresses below the body portion, the guiding slit for the spring adjacent its coil, and a rear view of the stationary component for the second embodiment.
Figure 6:
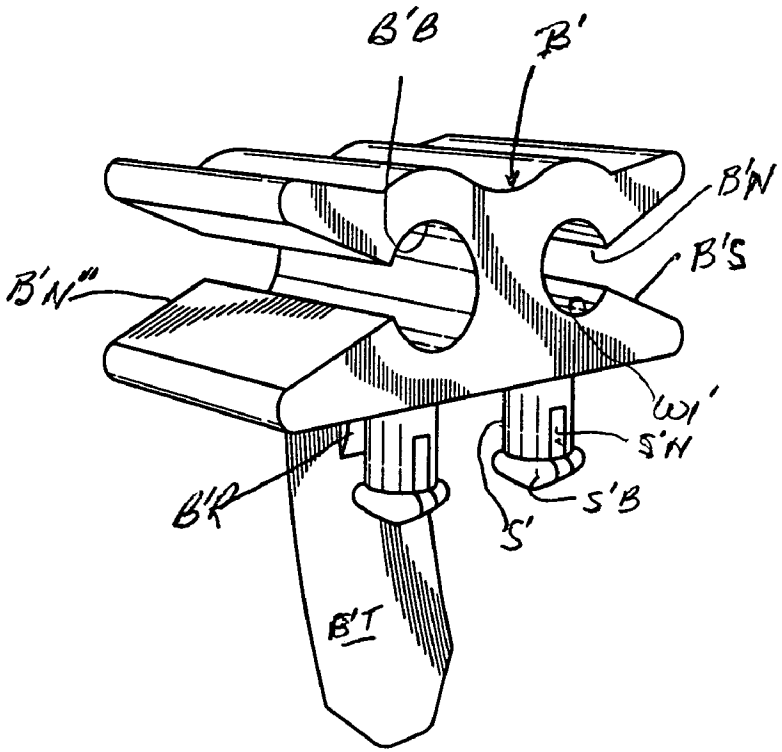
FIG. 6 is an enlarged (compared to FIGS. 4 and 5) perspective view taken from the right or rear at an angle different from those of FIGS. 4 and 5, of the stationary component alone of the second embodiment showing the laterally directed slots with their different diametrical sizes in the oppositely facing sides of that component for clamping engagement with the upper wire length adjacent its free end, the downwardly projecting notched pins or pegs, one for each of the laterally directed slots, for connection with an opening in the free end of the flat coil spring (as indicated at the left end of FIG. 4), as well as the downwardly projecting tab or tongue for augmenting the resistance afforded by the curved free end of the lower wire length to undesired release of the product packages suspended therefrom.
Figure 5:
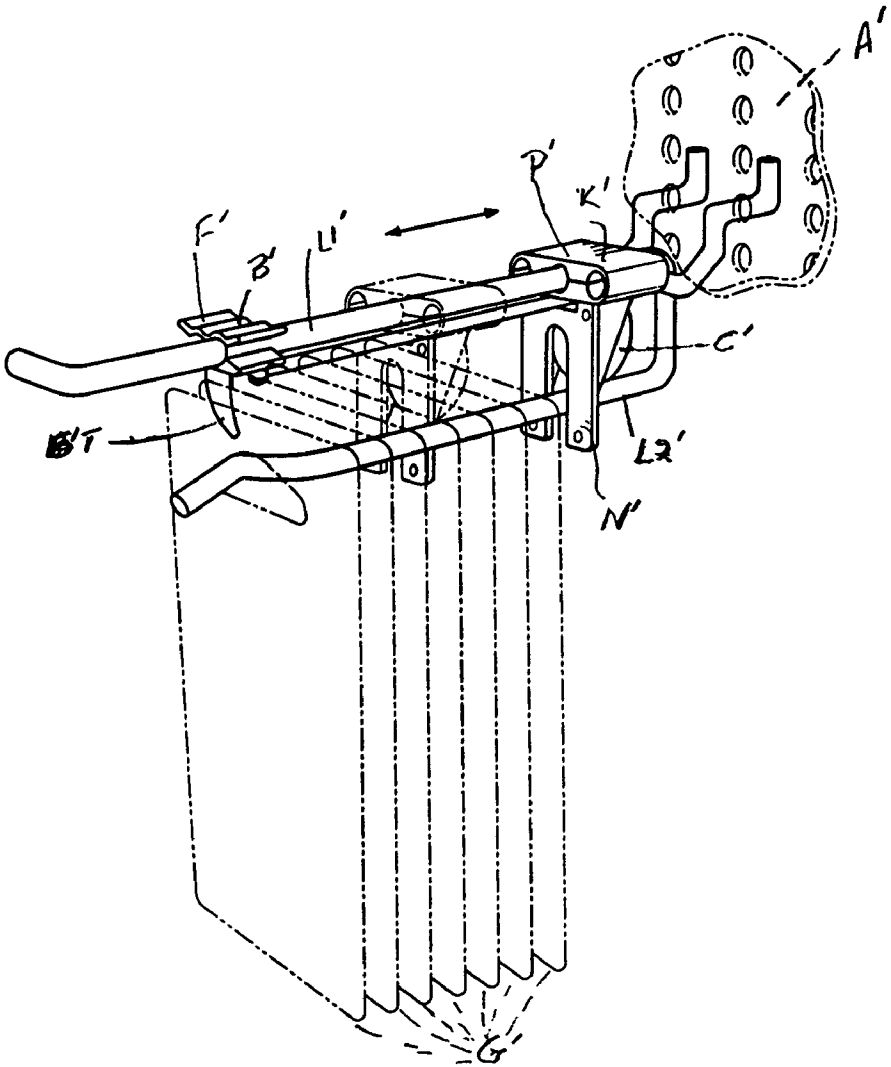
FIG. 5 is perspective view similar to FIG. 1 of the second embodiment of the invention showing on a reduced scale the constituent parts identified in the description of FIG. 4 when viewed from the left, and finally.

The second preferred embodiment of the invention is illustrated in FIGS. 4-6, of which FIGS. 4 and 5 are full perspective views taken from opposite ends of the assembly. In this case, the hook H2 has its two legs L1' and L2' spaced apart vertically with the bottom leg L2 carrying a row of product packages G' (see FIG. 5). The configuration of the end of the hook serving for support forms, as stated, no part of the invention and one known configuration for anchorage upon supporting board or panel A' is shown merely of illustration but will not be specifically described. The opposite end of leg L2 can be bent in shallow inverted V-shape for the same reason as the inclined end of hook H1, namely to add resistance to unintentional displacement of packages off of the hook leg.

The pusher component P' of the second embodiment is the same as that described above for the first embodiment due to the intention for the pusher to be interchangeable between the embodiments. Hence, a complete description thereof would be redundant (although the different views of the second embodiment do add in conveying an understanding thereof) and only those features of pusher P' that are relevant to the second embodiment will be specifically described, with other features given a prime designations to denote correspondence of parts.

It has already be mentioned that the body B' of the pusher has a third central bore (here W1') at is adapted to fit loosely around (for example with the same dimensions as set forth above for the first embodiment) the top leg L1 of the second embodiment of pusher hook H1 for free to and fro sliding movement of the pusher on the leg L1. In addition, given the presence of leg L2 below leg L1, the pusher plate N as well as the optional supplemental plate (not shown in FIGS. 4 and 5) plate should be provided with vertical slots such as slot NS opening from the bottom edge of main plate N' and as shown at NS' in FIG. 3) for the optional plate.

Turning now to the fixed component or part of the second embodiment designated F' (corresponding parts or components to be given prime designations where appropriate), with only one leg L1' to be clampingly engaged, the contour of part F' can be considerably simplified. Thus, it need have only one axially extending (relative to the hook length) cavity or bore W' for engagement with the leg L1'. While this part could certainly be formed with "clamshells" similar to the corresponding part of the first embodiment to be tightened together for a secure "grip" on the hook leg by set-screws or the like, it is preferred that it be formed with a body part B' having at least one laterally directed slot or mouth B'S through which the hook leg is introduced or inserted into the cavity W'. The diameter of cavity W' is selected to be slightly smaller by a few thousands of an inch than the diameter of the hook leg to be held therein while its slot has a neck or section B'N of reduced separation. In assembly, the hook leg is pressed sideways into the slot the sidewalls of which flex to admit the wire into the cavity for clamping (or press-fitted) engagement thereby. Most preferably, body part B' is formed with a second cavity W'2 on its side opposite from cavity W' and the second cavity likewise has necked-down slot B'N2 opening in the opposite lateral direction. Second cavity W'2 and its slot are given different dimensions from those for the first cavity to enable the fixed part F' to be used with hook legs of different thickness or diameter, as are known in the art. For example, the cavities and associated slot-like mouths could be sized for use with hook legs of about ¼ and 3/16 in. in diameter or thickness, respectively, with appropriate diameters and slot sizes for introduction of the corresponding leg therein and clamping engagement thereby.

To enable the second fixed part F' to anchor the free end of the coil spring driving the movable pusher part, body part B' is provided with a downwardly directed pin or peg S' having a vertical notch S'N and a circumferential bead S'B at its lower end. The diameter of peg S' is such as to fit within the anchoring opening at the spring end while its diameter at the bead exceeds that of the spring opening. However, the notch allows the peg end at the bead to be compressed to enable the spring opening to pass there over onto the peg. Once the spring opening has passed over the compressed beaded peg end, the latter returns to its normal diameter and the spring is securely retained thereon by the beaded end.

It is desirable for smooth easy movement of the coil spring that the (perpendicular) axis of peg S' be aligned with the axis of the cavity W', i.e. that the two axes intersect. Where two cavities are included, as is preferred, on opposite sides of the body part B', a separate peg S' is provided for each of the two cavities, each peg in proper alignment with the corresponding cavity. In this manner, the spring end E' is advanced and returned along a straight path without the application thereto of skewing forces that might result in binding of the extended spring.

To insure that the product packages in the second embodiment are not unintentionally pushed over the free end of its hook under the pushing action of the pusher plate under the impetus of its coil spring, the fixed body part B' of the second embodiment has a flexible retaining finger or tab B'F projecting downwardly therefrom a sufficient distance as to lie in the path of the upper edges of the product packages. The location of the body part B' along the length of the hook leg in the second embodiment can be adjusted by hand for the most effective holding action by the retaining finger which is generally in vertical alignment with the "crooked" end of the lower leg L2 of the product hook H2. Finger B'F can be slightly bent or curved from a true plane, as shown, with its curvature extending rearwardly from top to bottom for enhanced retaining effect and in any case, its flexibility permits a package to be deliberately displaced off of the free end of the hook.

Because the retaining finger is repeatedly flexed during use placing stress on its connection with the body part B', it is referred that this connection be reinforced by providing a wedge-shaped backing piece B'R at its top edge. The short side of the wedge is joined to the underside of the body part while its long side is joined to the backside of the finger. The length of the wedge-shaped piece can be varied to meet the demands of a particular set of circumstances but it normally need not extend the full length of the finger but perhaps the top one-third thereof.

Flat coil springs suitable for use in this invention are available from a number of manufacturers in a variety of "gauges" or tensile moduli. The choice of a particular spring depends mainly upon the product packages to be displayed and dispensed, especially their weight, and is best determined by trial and error with the actual packages.

The components of this invention can be made of various materials but a preferred material is polyethylene which gives good strength with a limited flexibility that is useful for certain elements and can be readily molded into the desired shapes. Other possible materials include polycarbonate, ABS, and what is known as "K-resin".

During the course of this description, reference has been made to a variety of alternatives and modifications and it will surely be realized that many other changes are possible without departing from this scope of this invention as defined by the claims. Similarly, words of approximation, such as "about", "substantially", "generally" and the like have been employed to indicate that small divergences are possible as is known in the art without departure from the spirit of the invention.

That which is claimed is:

1. A pusher accessory for a conventional elongated product display hook configured at one end for anchorage on a supporting panel or board and supporting in suspended fashion along its length a multiplicity of product items for removal from the opposite free end of said hook by a customer, which comprises a stationary component adapted to be attached in fixed position adjacent the free end of said hook; a movable component mountable on the hook at a point spaced from the stationary component for free sliding movement back and forth along the hook length and including a product-contacting face; and extensible spring means affixed at one end to the stationary component and carried at the other end by the movable component, said spring means being extended when the movable component is separated from the stationary component by intervening product packages suspended from the hook to apply spring tension force to the movable component and as product packages are removed from the free hook end one-by-one by customers to advance along the hook length the movable component and by its product-contacting face product packages intervening between the two components until the leading product package of those packages remaining on the hook reaches the free hook end, said spring means being a flat coil spring having a length extending from the spring coil parallel to the hook length with its free end affixed to said stationary component, and said movable component includes two brackets having coil-contacting surfaces extending parallel to the hook length, said surfaces being spaced apart laterally of the hook length a distance sufficient to support the coil of said spring there between for said free uncoiling and re-coiling movement and further includes guiding means generally perpendicular to said bracket surfaces for guiding the extended spring length along a fixed path parallel to the hook length as said spring coil uncoils and re-coils.

2. The pusher accessory of claim 1 wherein said guiding means comprises a narrow elongated guiding slot formed in said movable component above said bracket surfaces with its lengthwise axis perpendicular to said bracket surfaces, the length and width of said slot being sufficient for the free passage of said spring length there through while confining said spring length against significant deviation from its fixed path during its lengthwise movement.

3. The pusher accessory of claim 2 wherein said movable component comprises a body part enclosing a short length of said hook for free to-and-fro movement there along and having a plate depending therefrom with a generally fiat surface thereof extending generally perpendicular to the hook length and constituting said a package-contacting surface and said guiding slot is situated adjacent an upper edge of said package contacting surface.

4. The pusher accessory of claim 1 wherein said fixed component comprises spring-end engaging means substantially aligned with a vertical plane passing through the axis of said hook.

5. The pusher accessory of claim 1 wherein said fixed component comprises clamping means for clampingly engaging said hook adjacent its free end to fix the component on said hook.

6. The pusher accessory of claim 1 wherein said hook comprises two elongated generally parallel legs and said movable component comprises a body part having generally cylindrical bores passing there through parallel to the leg length for loose reception of said legs to enable said component to move freely along the legs.

7. The pusher accessory of claim 6 wherein said generally parallel legs of said hook are joined at their free ends to form a U-shaped bight and said fixed component comprises clamping means for clampingly gripping said bight generally in the center thereof.

8. The pusher accessory of claim 7 wherein said U-shaped bight is inclined upwardly at a small angle and the body part of said fixed component includes a generally similarly upwardly inclined extension thereon and said clamping means is carried at the end of said extension.

9. The pusher accessory of claim 8 wherein said clamping means on said extension comprises a generally C-shaped socket for clamping around the U-shaped bight of said legs at the center of said U.

10. The pusher accessory of claim 1 wherein said hook has two legs extending generally parallel with one disposed above the other and said movable component comprises a body part having a centrally disposed bore to sliding reception of the upper leg.

11. The pusher accessory according to claim 1 wherein said product display hook has two generally vertically parallel legs connected together at one of their ends and configured at such ends for anchorage in the supporting board or panel with the opposite ends thereof free, the lower of the two legs functioning to support product display packages suspended therefrom, and the stationary component of the accessory comprises a body portion laterally slotted along at least one of its side for clamping engagement with the upper of the legs adjacent the free end thereof, the body portion having on an underside a connecting means for attachment to the free end of spring means carried at its other end by said movable component.

12. The pusher accessory of claim 11 wherein said body portion of the stationary component has laterally opening slots on both of its two opposite sides, the diameters of said two slots being different for clamping engagement of hook legs of correspondingly different sizes.

13. A pusher accessory according to claim 1 wherein each of said brackets terminates on a side thereof facing toward said free hook end with a surface which is perpendicular to the length of said hook and comprises said product-contacting face.

14. A pusher accessory according to claim 1 wherein said stationary component comprises a body part adapted to fit between the legs of said hook and having lateral sides thereof recessed to at least partially receive a short length of said legs therein, a short projection carried by said body part on a side thereof parallel to the hook length, said projection extending perpendicularly to the hook length for engagement with an aperture provided in the spring adjacent its free end to thereby secure the hook end to said stationary component, and a cover plate adapted to be anchored to such body part side in overlying relation to the apertured spring end to prevent accidental disengagement of the spring aperture from said projection during movement of said movable component.

15. A pusher accessory according to claim 14 wherein the side of said body part carrying said projection is the underside thereof.

16. A pusher accessory according to claim 15 wherein said underside of said body part is flat, and said projection is a short peg dependent from the underside of said body part located generally centrally between the recessed lateral sides of said body part, whereby when said spring aperture is engaged on said peg and said cover plate is anchored on said body part over the apertured spring end, said apertured apertured spring end is positively maintained in flat condition.

17. A pusher accessory according to claim 16 wherein said cover plate has a lateral dimension less than that of the body part of said stationary component, the underside of such body part is stepped at its lateral margins to receive the cover plate between said steps, said steps and cover plate having substantially the same thickness and said peg having a length not greater than the thickness of such body part, whereby the underside of such body part with the cover plate is place is free of obstructions that might interfere with the free removal of said product packages from the free hook end.

18. A pusher accessory for a conventional elongated product display hook configured at one end for anchorage on a supporting panel or board and supporting in suspended fashion along its length a multiplicity of product items for removal from the opposite free end of said hook by a customer, which comprises a stationary component adapted to be attached in fixed position adjacent the free end of said hook; a movable component mountable on the hook at a point spaced from the stationary component for free sliding movement back and forth along the hook length and including a product-contacting face; and extensible spring means affixed at one end to the stationary component and carried at the other end by the movable component, said spring means being extended when the movable component is separated from the stationary component by intervening product packages suspended from the hook to apply spring tension force to the movable component and as product packages are removed from the free hook end one-by-one by customers to advance along the hook length the movable component and by its product-contacting face product packages intervening between the two components until the leading product package of those package remaining on the hook reaches the free hook end, said movable component comprising a body part having a centrally disposed bore flanked of either of its side by lateral bores, said central bore being adapted to slidably receive the upper leg of a two-leg hook having the legs arranged vertically one above the other, and the lateral bores are separated laterally a distance corresponding to the separation of legs of a two-leg hook having the legs arranged horizontally for receiving said horizontally separated legs, whereby said body part can be interchangeable between the two hooks.

* * * * *